US009583089B2

(12) United States Patent
Nagashima et al.

(10) Patent No.: US 9,583,089 B2
(45) Date of Patent: Feb. 28, 2017

(54) BUZZER OUTPUT CONTROL DEVICE AND BUZZER OUTPUT CONTROL METHOD

(71) Applicant: CALSONIC KANSEI CORPORATION, Saitama-shi, Saitama (JP)

(72) Inventors: Norihiro Nagashima, Saitama (JP); Sou Sawada, Saitama (JP)

(73) Assignee: CALSONIC KANSEI CORPORATION, Saitama-shi, Saitama (JP)

( * ) Notice: Subject to any disclaimer, the term of this patent is extended or adjusted under 35 U.S.C. 154(b) by 149 days.

(21) Appl. No.: 14/647,256

(22) PCT Filed: Sep. 17, 2013

(86) PCT No.: PCT/JP2013/005483

§ 371 (c)(1),
(2) Date: May 26, 2015

(87) PCT Pub. No.: WO2014/103104

PCT Pub. Date: Jul. 3, 2014

(65) Prior Publication Data

US 2015/0317971 A1 Nov. 5, 2015

(30) Foreign Application Priority Data

Dec. 26, 2012 (JP) ..... 2012-282746

(51) Int. Cl.
*G08B 3/00* (2006.01)
*G10K 9/12* (2006.01)
(Continued)

(52) U.S. Cl.
CPC ..... *G10K 9/12* (2013.01); *G10K 9/18* (2013.01); *H04R 3/00* (2013.01); *H04R 2430/01* (2013.01); *H04R 2499/13* (2013.01)

(58) Field of Classification Search
CPC ..... G08B 13/1409; G08B 6/00; G10K 9/122; G10K 9/15
(Continued)

(56) References Cited

U.S. PATENT DOCUMENTS 4,380,743 A * 4/1983 Underhill ..... H03L 7/1978 327/105
2006/0130637 A1* 6/2006 Crebouw ..... G10L 19/0204 84/603
(Continued)

FOREIGN PATENT DOCUMENTS

JP H08-279090 A 10/1996
JP H10-214090 A 8/1998
(Continued)

OTHER PUBLICATIONS

May 5, 2016, Office Action issued by the State Intellectual Property Office in the corresponding Chinese Patent Application No. 201380066701.9 with English language concise explanation of the relevance.
(Continued)

*Primary Examiner* — Daryl Pope
(74) *Attorney, Agent, or Firm* — Kenja IP Law PC

(57) ABSTRACT

Provided is a buzzer that sounds without noise contamination. Specifically, an inaudible frequency signal generation unit 22 generates an inaudible frequency pulse signal P0; an audio frequency signal generation unit 26 generates, from the signal P0, an audio frequency pulse signal P1: a signal synthesizing unit 28 generates a synthesized frequency pulse signal P2 having the signal P0 in an ON time of the signal P1; a first duty ratio setting unit 30 sets a duty ratio Di of the signal P0 in the signal P2 to gradually increase over a first predetermined period of the signal P2, and thus generates a buzzer driving signal P3; and a buzzer driving unit 40 makes a buzzer 60 sound with a pitch corresponding to a frequency of the signal P3 and volume corresponding to the duty ratio of the signal P3.

4 Claims, 6 Drawing Sheets

(51) Int. Cl.
*H04R 3/00* (2006.01)
*G10K 9/18* (2006.01)

(58) Field of Classification Search
USPC ..... 340/635, 657, 658, 659, 407.1, 384.1, 340/384.6, 388.1
See application file for complete search history.

(56) References Cited

U.S. PATENT DOCUMENTS

| | | | | |
|---|---|---|---|---|
| 2006/0235753 | A1* | 10/2006 | Kameyama ..... | B60H 1/00742 705/15 |
| 2007/0192038 | A1* | 8/2007 | Kameyama ..... | G01C 21/3641 702/19 |
| 2015/0317971 | A1* | 11/2015 | Nagashima ..... | H04R 3/00 340/388.1 |

FOREIGN PATENT DOCUMENTS

| | | | |
|---|---|---|---|
| JP | 2003-058164 | A | 2/2003 |
| JP | 2009-260544 | A | 11/2009 |
| JP | 2012-171462 | A | 9/2012 |

OTHER PUBLICATIONS

Nov. 5, 2013 International Search Report issued in International Patent Application No. PCT/JP2013/005483.

* cited by examiner

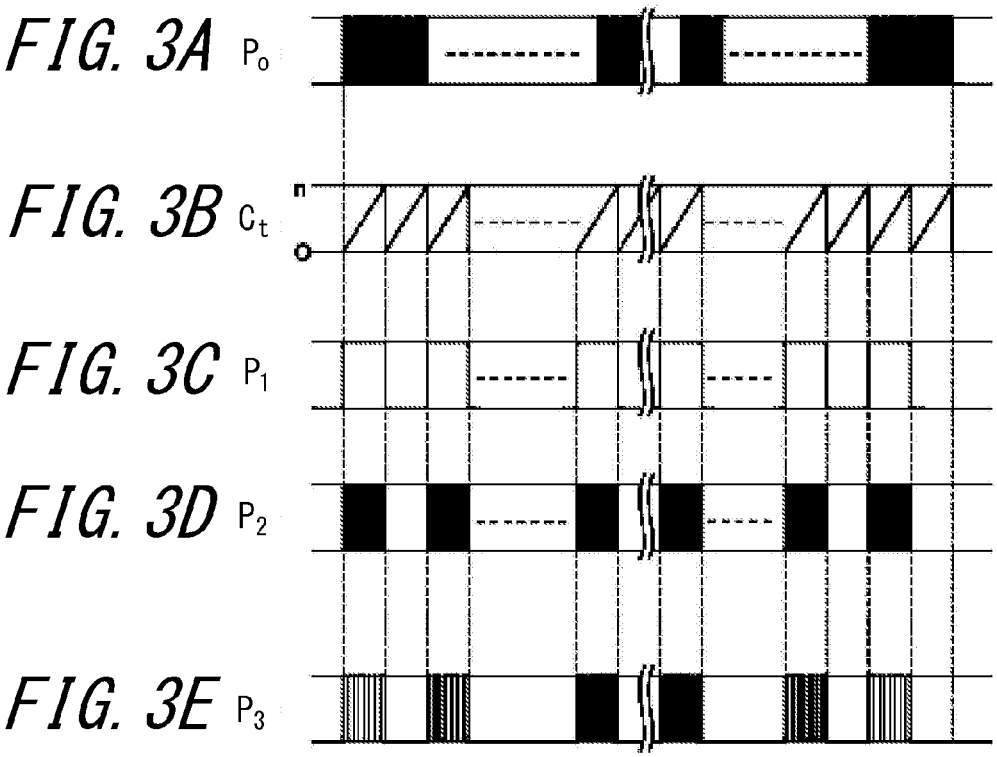
FIG. 4
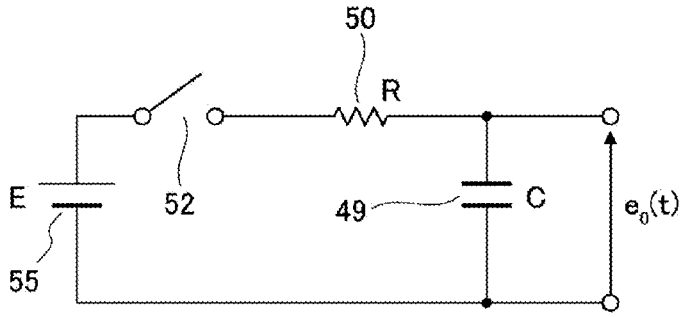

BUZZER OUTPUT CONTROL DEVICE AND BUZZER OUTPUT CONTROL METHOD

CROSS REFERENCE TO RELATED APPLICATION

This application claims priority to and the benefit of Japanese Patent Application No. 2012-282746 (filed on Dec. 26, 2012), the entire contents of which are incorporated herein by reference.

TECHNICAL FIELD

This disclosure relates to a buzzer output control device for outputting a beep sound and a buzzer output control method.

BACKGROUND

A vehicle such as an automobile, in order to immediately notify a driver of the occurrence of various unexpected events (for example, a door is left open, a light is left on, etc.) and draw attention of the driver, generates a beep sound by sounding a buzzer. The beep sound has been generated by inputting a square wave at a frequency corresponding to a frequency of a desired sound (for example, 2 kHz) to a buzzer driving circuit and applying the square wave to the buzzer.

In general, such a buzzer driving circuit is configured to receive an input of the square wave and, upon reception of the input of the square wave, causes a large inrush current flowing thereto, which may have an impact to generate a momentarily abnormal noise. Also, at the moment when the input of the square wave is finished, a counter electromotive force generated in the buzzer serving as an inductive load may have an impact to cause the momentarily abnormal noise.

As such, in order to prevent noise contamination by subduing a rapid change in a level of the signal input to the buzzer, a low-pass filter (for example, a CR filter that consists of a resistor and a capacitor) is inserted into an input stage of the rectangular wave, thereby dulling the square wave and preventing the rapid change in the level of the signal input to the buzzer (for example, PLT 1).

CITATION LIST

Patent Literature

PTL 1: Japanese Patent Application Laid-Open Publication No. 8-279090

However, since the buzzer driving circuit described in the PLT 1 requires the low-pass filter (e.g., the CR filter) be inserted into the input stage of the square wave, there has been a problem that the number of components constituting the buzzer driving circuit is increased.

In view of the above circumstances, it could be helpful to provide a buzzer output control apparatus and a buzzer output control method that are capable of, without inserting the low-pass filter into the buzzer driving circuit, sounding the buzzer without noise contamination.

SUMMARY

Our buzzer output control device and buzzer output control method, without inserting a low-pass filter into a buzzer driving circuit, sound a buzzer without noise contamination.

That is, our buzzer output control device includes: a buzzer for outputting a sound having a pitch corresponding to a frequency of a buzzer driving signal being input and volume corresponding to a duty ratio of the buzzer driving signal; an inaudible frequency signal generation unit for generating an inaudible frequency pulse signal having a predetermined inaudible frequency; an audio frequency signal generation unit for generating an audio frequency pulse signal having a predetermined audio frequency lower than the inaudible frequency; a signal synthesizing unit for synthesizing the inaudible frequency pulse signal and the audio frequency pulse signal and thus generating a synthesized frequency pulse signal having the inaudible frequency pulse signal in an ON time of the audio frequency pulse signal; a first duty ratio setting unit for generating a buzzer driving signal set to gradually increase a duty ratio of the inaudible frequency pulse signal in the synthesized frequency pulse signal over a first predetermined period of the synthesized frequency pulse signal; and a buzzer driving unit for sounding the buzzer on the buzzer driving signal.

According to the buzzer output control device configured in this manner, the inaudible frequency signal generation unit generates the inaudible frequency pulse signal having the predetermined inaudible frequency; the audio frequency signal generation unit generates the audio frequency pulse signal having the predetermined audio frequency lower than the inaudible frequency; the signal synthesizing unit synthesizes the inaudible frequency pulse signal and the audio frequency pulse signal and thus generates the synthesized frequency pulse signal having the inaudible frequency pulse signal in the ON time of the audio frequency pulse signal; the first duty ratio setting unit generates the buzzer driving signal set to gradually increase the duty ratio of the inaudible frequency pulse signal in the synthesized frequency pulse signal over the first predetermined period of the synthesized frequency pulse signal; and the buzzer driving unit sounds the buzzer with the pitch corresponding to the frequency of the buzzer driving signal and volume corresponding to the duty ratio of the buzzer driving signal. Therefore, a peak value of a voltage applied to the buzzer gradually increases with time immediately after the application of the buzzer driving signal, thereby preventing the occurrence of an inrush current. Accordingly, without inserting a low-pass filter into the buzzer driving unit, the buzzer may sound without noise contamination.

Also, our buzzer output control device includes: a buzzer for outputting a sound having a pitch corresponding to a frequency of a buzzer driving signal being input and volume corresponding to a duty ratio of the buzzer driving signal; an inaudible frequency signal generation unit for generating an inaudible frequency pulse signal having a predetermined inaudible frequency; an audio frequency signal generation unit for generating an audio frequency pulse signal having a predetermined audio frequency lower than the inaudible frequency; a signal synthesizing unit for synthesizing the inaudible frequency pulse signal and the audio frequency pulse signal and thus generating a synthesized frequency pulse signal having the inaudible frequency pulse signal in an ON time of the audio frequency pulse signal; a second duty ratio setting unit for generating a buzzer driving signal set to gradually reduce a duty ratio of the inaudible frequency pulse signal in the synthesized frequency pulse signal over a last predetermined period of the synthesized frequency pulse signal; and a buzzer driving unit for sounding the buzzer on the buzzer driving signal.

According to the buzzer output control device configured in this manner, the inaudible frequency signal generation unit generates the inaudible frequency pulse signal having the predetermined inaudible frequency; the audio frequency signal generation unit generates the audio frequency pulse signal having the predetermined audio frequency lower than the inaudible frequency; the signal synthesizing unit synthesizes the inaudible frequency pulse signal and the audio frequency pulse signal and thus generates the synthesized frequency pulse signal having the inaudible frequency pulse signal in the ON time of the audio frequency pulse signal; the second duty ratio setting unit generates the buzzer driving signal set to gradually reduce the duty ratio of the inaudible frequency pulse signal in the synthesized frequency pulse signal over the last predetermined period of the synthesized frequency pulse signal; and the buzzer driving unit sounds the buzzer with the pitch corresponding to the frequency of the buzzer driving signal and volume corresponding to the duty ratio of the buzzer driving signal. Therefore, the peak value of the voltage applied to the buzzer gradually decreases with time immediately after the end of the buzzer driving signal, thereby preventing the occurrence of a counter electromotive force when the buzzer serving as an inductive load is turned OFF. Accordingly, without inserting the low-pass filter into the buzzer driving unit, the buzzer may sound without noise contamination.

Our buzzer output control method includes: generating an inaudible frequency pulse signal having a predetermined inaudible frequency; generating an audio frequency pulse signal having a predetermined audio frequency lower than the inaudible frequency; generating a synthesized frequency pulse signal by incorporating the inaudible frequency pulse signal in an ON time of the audio frequency pulse signal; generating a buzzer driving signal set to gradually increase a duty ratio of the inaudible frequency pulse signal in the synthesized audio frequency pulse signal over a first predetermined period of the synthesized frequency pulse signal; and, on the buzzer driving signal, sounding the buzzer with a pitch corresponding to the frequency of the buzzer driving signal and volume corresponding to the duty ratio of the buzzer driving signal.

According to the buzzer output control method configured in this manner, since the buzzer sounds on the buzzer driving signal that is set to gradually increase the duty ratio of the inaudible frequency pulse signal in the synthesized frequency pulse signal over the first predetermined period of the synthesized frequency pulse signal, the occurrence of an inrush current may be prevented. Accordingly, without passing the buzzer driving signal through the low-pass filter, the buzzer may sound without noise contamination.

Further, our buzzer output control method includes: generating an inaudible frequency pulse signal having a predetermined inaudible frequency; generating an audio frequency pulse signal having a predetermined audio frequency lower than the inaudible frequency; generating a synthesized frequency pulse signal by incorporating the inaudible frequency pulse signal in an ON time of the audio frequency pulse signal; generating a buzzer driving signal set to gradually reduce a duty ratio of the inaudible frequency pulse signal in the synthesized audio frequency pulse signal over a last predetermined period of the synthesized frequency pulse signal; and, on the buzzer driving signal, sounding the buzzer with a pitch corresponding to the frequency of the buzzer driving signal and volume corresponding to the duty ratio of the buzzer driving signal.

According to the buzzer output control method configured in this manner, since the buzzer sounds on the buzzer driving signal that is set to gradually reduce the duty ratio of the inaudible frequency pulse signal in the synthesized frequency pulse signal over the last predetermined period of the synthesized frequency pulse signal, the occurrence of a counter electromotive force may be prevented when the buzzer serving as an inductive load is turned OFF. Accordingly, without passing the buzzer driving signal through the low-pass filter, the buzzer may sound without noise contamination.

Our buzzer output control apparatus and buzzer output control method are capable of, without using a CR filter in a buzzer driving circuit, sounding a buzzer without noise contamination caused at the start and end of the sound.

BRIEF DESCRIPTION OF THE DRAWINGS

In the accompanying drawings,

FIGS. 3 are diagrams illustrating a procedure for generating a waveform of a voltage applied to a buzzer: FIG. 3A is a diagram illustrating an example of a waveform of an inaudible frequency pulse signal; FIG. 3B is a diagram illustrating a counter signal output by a counter when the number of pulses of the inaudible frequency pulse signal is counted; FIG. 3C is a diagram illustrating a waveform of an audio frequency pulse signal generated based on the counter signal; FIG. 3D is a diagram illustrating a waveform of a synthesized frequency pulse signal generated by synthesizing the inaudible frequency pulse signal and the audio frequency pulse signal; and FIG. 3E is a diagram illustrating a waveform of a buzzer driving signal set to change a duty ratio of the inaudible frequency pulse signal in the synthesized frequency pulse signal according to time;

FIG. 4 is a diagram illustrating a structure of a CR filter;

FIG. 6 are diagrams illustrating examples of a waveform of a voltage applied to the buzzer according to a first embodiment.

DETAILED DESCRIPTION

Hereinafter, an embodiment of our buzzer output control device and buzzer output control method will be described with reference to the accompanying drawings.

First Embodiment (Configuration of First Embodiment)

Figure 1:
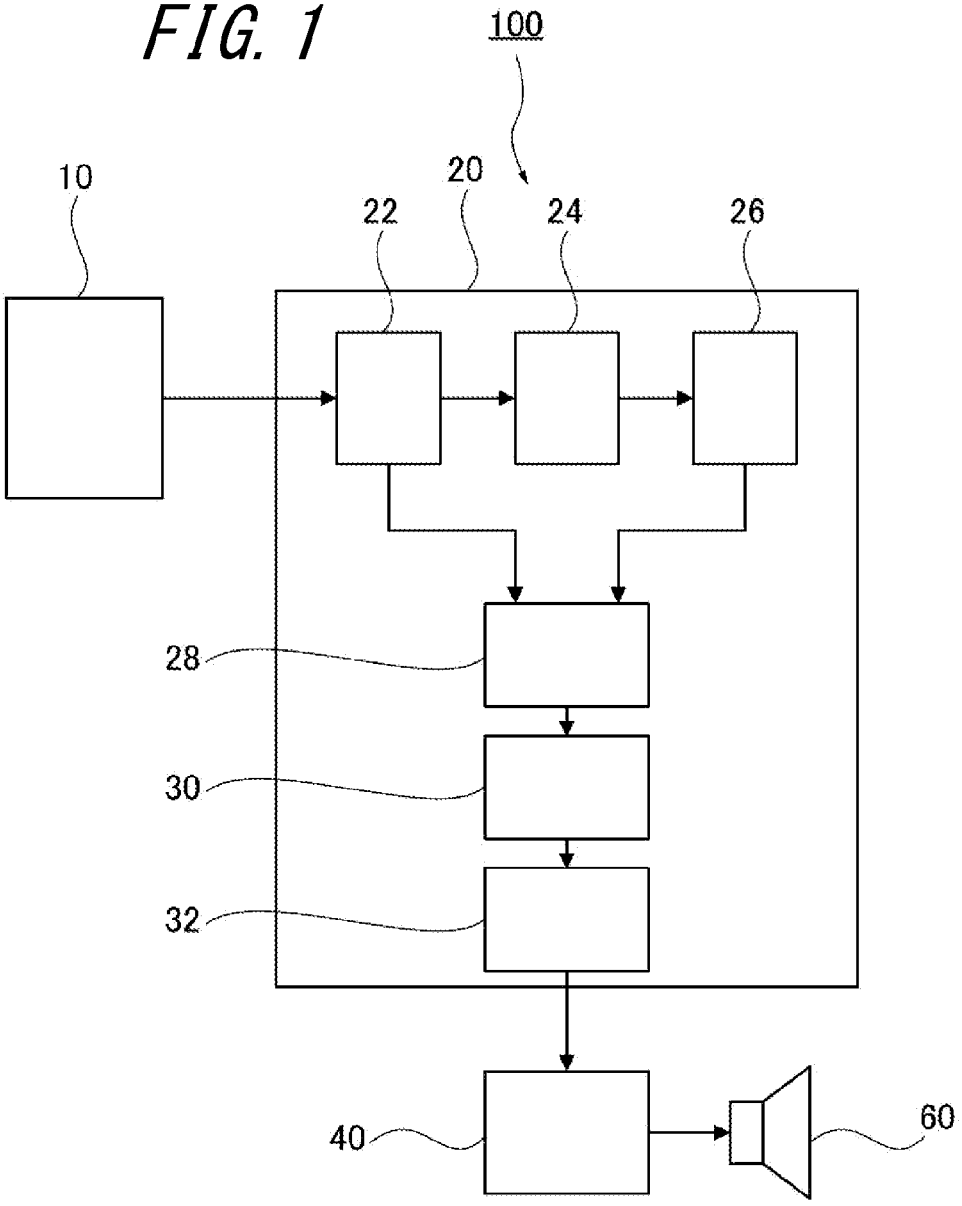
FIG. 1 is a block diagram illustrating a configuration of our buzzer output control device.

Hereinafter, a first embodiment will be described. Our buzzer output control device 100, as illustrated in FIG. 1, includes: a buzzer 60 mounted in a vehicle, which is not shown, for issuing notification of events such as a door is left open and a light is left on; a clock signal generation unit 10 for generating a reference clock signal Pc, which is a pulse signal at a predetermined frequency, serving as a source of a buzzer driving signal P3 for making the buzzer 60 sound; a buzzer driving signal generation unit 20 for generating the buzzer driving signal P3 based on the reference clock signal Pc; and a buzzer driving unit 40 for applying the buzzer driving signal P3 generated by the buzzer driving signal generation unit 20 to the buzzer 60 and thereby sounding the buzzer 60.

The buzzer 60 is constituted by using, for example, a piezoelectric buzzer. The piezoelectric buzzer has a structure having a piezoelectric element and a metal plate attached to each other. When a voltage is externally applied to the piezoelectric element, the piezoelectric element deforms stretching and contracting. Such stretching and contracting deformation is delivered to the metal plate, causing the metal plate to bend and generate a sound.

The buzzer driving signal generation unit 20 further includes: an inaudible frequency signal generation unit 22 for dividing the reference clock signal Pc and thereby obtaining an inaudible frequency pulse signal P0 having a predetermined inaudible frequency; a pulse counter 24 for counting the number of pulses of the inaudible frequency pulse signal P0 generated by the inaudible frequency signal generation unit 22; an audio frequency signal generation unit 26 for generating, based on the number of pulses of the inaudible frequency pulse signal P0 counted by the pulse counter 24, an audio frequency pulse signal P1 having a predetermined audible frequency lower than the inaudible frequency; a signal synthesizing unit 28 for synthesizing the audio frequency pulse signal P1 and the inaudible frequency pulse signal P0 and thus generating a synthesized frequency pulse signal P2 having the inaudible frequency pulse signal P0 in a segment where the audio frequency pulse signal P1 is ON; a first duty ratio setting unit 30 for generating a buzzer driving signal P3 for setting a duty ratio of a first predetermined period of the inaudible frequency pulse signal P0 in the synthesized frequency pulse signal P2 to a predetermined value; and a second duty ratio setting unit 32 for generating the buzzer driving signal P3 for setting a duty ratio of a last predetermined period of the inaudible frequency pulse signal in the synthesized frequency pulse signal P2 to a predetermined value.

Next, referring to FIG. 2, a configuration of the buzzer driving unit 40 will be described.

Figure 2:
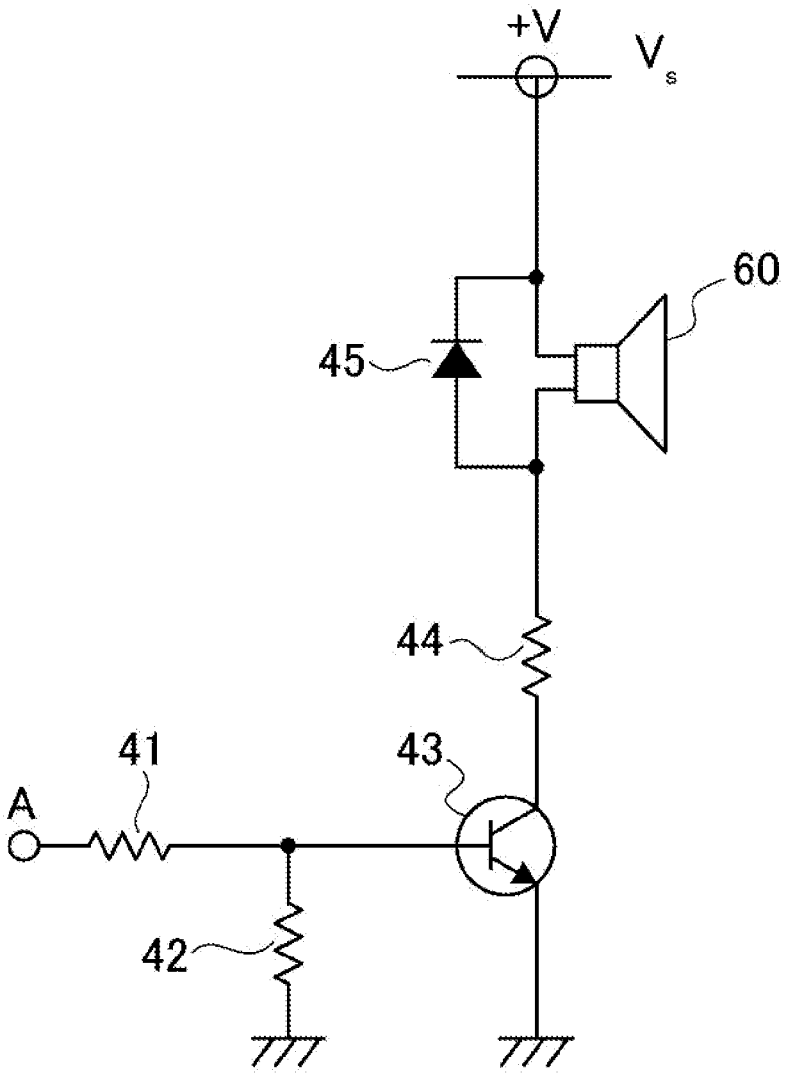
FIG. 2 is a circuit diagram illustrating an example of a circuit structure of a buzzer driving unit.

FIG. 2 illustrates an example of a circuit diagram including the buzzer driving unit 40 and the buzzer 60 connected thereto. The buzzer driving signal P3 generated by the buzzer driving signal generation unit 20 (see FIG. 1) is input to a terminal A in FIG. 2.

The buzzer driving signal P3 input from the terminal A is divided by resistors 41 and 42 and applied to a base of a transistor 43 (a switching element). Thereby, the transistor 43 becomes electrically connected, allowing a current to flow from a DC power source Vs of a voltage V toward the buzzer 60, a resistor 44, and the transistor 43. At this time, the buzzer 60 sounds at a frequency corresponding to the audio frequency of the buzzer driving signal P3 applied to the base of the transistor 43. Volume of this sound corresponds to the duty ratio of the buzzer driving signal P3, that is, the buzzer 60 sounds louder in proportion to the duty ratio (in proportion to a length of an ON time of the pulse). Note that a diode 45 is inserted so as to absorb a counter electromotive force generated in the buzzer 60.

(Method of Generating Synthesized Frequency Pulse Signal P2)

Here, by using a case for generating a beep sound at a frequency of 2 kHz from the buzzer 60 as an example, a method of generating the buzzer driving signal P3 will be described with reference to FIG. 1 and FIGS. 3.

First, the clock signal generation unit 10 generates the reference clock signal Pc having a predetermined frequency. The predetermined frequency is a frequency preliminarily determined. The reference clock signal Pc may be generated by using software, or hardware that uses an oscillation circuit.

Next, the inaudible frequency signal generation unit 22 divides the reference clock signal Pc and generates the inaudible frequency pulse signal P0 having the predetermined inaudible frequency (e.g. 500 kHz) sufficiently higher than 2 kHz, which is a frequency of the sound to be output from the buzzer 60 (FIG. 3A). This division may be carried out by using software, or hardware having a function of a divider.

The inaudible frequency pulse signal P0 thus generated is input to the pulse counter 24, and the pulse counter 24 counts until the number of pulses reaches a predetermined value n (126 in the present embodiment). When the number of pulses reaches the predetermined value n, the pulse counter 24 resets the counted number to 0 and repeats counting the number of pulses of the inaudible frequency pulse signal P0. Thereby, a counter signal Ct illustrated in FIG. 3B is generated.

Then, the audio frequency signal generation unit 26 maintains a high level (ON) or a low level (OFF) until the number of pulses constituting the inaudible frequency pulse signal P0 reaches the predetermined value n. When the number of pulses reaches the predetermined value n, the audio frequency signal generation unit 26 generates a signal to switchover between the high level and the low level. Thereby, the audio frequency pulse signal P1 illustrated in FIG. 3C is generated.

Next, the signal synthesizing unit 28, by operating logical product of the inaudible frequency pulse signal P0 and the audio frequency pulse signal P1, synthesizes the inaudible frequency pulse signal P0 and the audio frequency pulse signal P1 and thus generates the synthesized frequency pulse signal P2. In the synthesized audio frequency pulse signal P2 thus generated, as illustrated in FIG. 3D, the inaudible frequency pulse signal is incorporated in the segment where the audio frequency pulse signal is at the high level (ON).

(Method of Generating Buzzer Driving Signal P3)

Next, a buzzer driving signal P3 is generated so as to change a duty ratio Di of the inaudible frequency pulse signal P0 in the synthesized frequency pulse signal P2. A method of generating the buzzer driving signal P3 will be described with reference to FIG. 1 and FIGS. 3. Note that the duty ratio Di is changed for the purpose of, as described above, preventing an abnormal noise generated at the start and end of the sound of the buzzer. The duty ratio D1 is changed so as to gradually increase the voltage applied to the buzzer 60 when the buzzer 60 starts sounding, thereby preventing a large inrush current from flowing to the buzzer 60. Also, the duty ratio D1 is changed so as to gradually reduce the voltage applied to the buzzer 60 when the buzzer 60 ends sounding, thereby preventing generation of a large counter electromotive force in the buzzer 60.

Here, when the duty ratio Di of the buzzer driving signal P3 input to the buzzer 60 (i.e., the ON time of the pulse) is reduced, the power applied to the buzzer 60 is also reduced. Therefore, the voltage applied to the buzzer 60 is reduced, reducing the volume of the sound output from the buzzer 60 accordingly. On the other hand, when the duty ratio Di of the buzzer driving signal P3 input to the buzzer 60 (i.e., the ON time of the pulse) is increased, the power applied to the buzzer 60 is also increased. Therefore, the voltage applied to the buzzer 60 is increased, increasing the volume of the sound output from the buzzer 60 accordingly.

Next, a method of changing the duty ratio Di will be described. The synthesized frequency pulse signal P2 consists of segments including the inaudible frequency pulse signal P0 and segments of a low level. Here, the segments including the inaudible frequency pulse signal P0 are referred to as segments R1, R2, . . . Ri, . . . , and Rn, in the mentioned order from the left side in FIG. 3D.

The first duty ratio setting unit 30 preliminarily stores duty ratios D1, D2, . . . , Di, . . . , and Dn set for the segments R1, R2, . . . , Ri, . . . , and Rn of the synthesized frequency pulse signal P2, respectively.

Each time the segments R1, R2, . . . , Ri, . . . , and Rn of the synthesized frequency pulse signal P2 input to the first duty ratio setting unit 30 are detected, the duty ratio Di corresponding to the segment Ri is retrieved from the first duty ratio setting unit 30 and, based on the duty ratio Di thus retrieved, the duty ratio of the segment Ri is changed to Di.

At this time, since the frequency of the inaudible frequency pulse signal P0 and a length of the segment Ri (time) are known, the number of pulses constituting the inaudible frequency pulse signal P0 in the segment Ri is thinned out based on the duty ratio to be set, whereby the duty ratio in the segment Ri may be changed to a predetermined value.

Note that, since the inaudible frequency pulse signal P0 has a high frequency, it is necessary to rapidly carry out the retrieval of the duty ratio Di stored in the first duty ratio setting unit 30 and the change of the duty ratio of the synthesized frequency pulse signal P2. To that end, the retrieval and the change may be rapidly carried out by, rather than reading information stored in a memory from a CPU, using a function to directly exchange information between memories, which is what is called a DMA (Direct Memory Access) function.

That is, a value of the duty ratio Di corresponding to each segment Ri preliminarily stored in the first duty ratio setting unit 30 is rapidly retrieved by the DMA function and transferred to a memory used for setting the duty ratio of the synthesized frequency pulse signal P2. Thereby, the duty ratio is changed by using the value of the duty ratio Di transferred.

(Method of Setting Duty Ratio of Buzzer Driving Signal P3)

Next, a method of setting the duty ratios D1, D2, . . . , Di, . . . , and Dn will be described in detail. As described above, reducing the duty ratio Di reduces the volume of the sound output from the buzzer 60, while increasing the duty ratio Di increases the volume of the sound output from the buzzer 60. Preferably, a degree of increasing the volume and a degree of reducing the volume are set to be equal to a time constant τ representing a degree of frequency response of a low-pass filter that has conventionally been inserted into the buzzer driving unit.

FIG. 4 illustrates a CR filter, which is a typical low-pass filter having the DC power supply 55 of a voltage E connected to, via a switch 52, a resistor 50 having a resistance value R and a capacitor 49 having a capacitance C.

In FIG. 4, a voltage generated at both ends of the capacitor 49 when the switch 52 is closed is represented by $e_0(t)$, provided that t represents time. At this time, the voltage $e_0(t)$ is expressed by Equation 1.

$$e_0(t)=E*\{1-\exp(-t/RC)\} \quad \text{(Equation 1)}$$

That is, the voltage $e_0(t)$ generated at the both ends of the capacitor 49, after the switch 52 is turned on, gradually increases at a speed corresponding to time determined by the following equation: time constant τ=RC.

On the other hand, the voltage $e_0(t)$ generated at both ends of the capacitor 49 when the switch 52, which has been once closed, is opened is expressed by Equation 2, provided that the t represents time.

$$e_0(t)=E*\exp(-t/RC) \quad \text{(Equation 2)}$$

That is, the voltage $e_0(t)$ generated at the both ends of the capacitor 49 gradually reduces, after the switch 52 is opened, at a speed corresponding to the time determined by the equation: time constant τ=RC.

Then, the voltage $e_0(t)$ thus generated at the both ends of the capacitor 49 is applied to the buzzer 60 so as to sound the buzzer 60. Thereby, a rapid change in the voltage is subdued, and an abnormal noise generated due to the aforementioned inrush current may be prevented.

Since the circuit in FIG. 4 functions as the low-pass filter, when a DC power source at a certain frequency is connected in place of the DC power source 55, a component of the certain frequency of the DC power source equal to and higher than a frequency $f_c$ calculated from Equation 3 is cut off.

$$f_c=1/2\pi RC \quad \text{(Equation 3)}$$

Here, the frequency $f_c$ is referred to as a cut-off frequency.

That is, when the frequency of the audio frequency pulse signal P1 of a desired sound to be generated by the buzzer is represented by $f_0$, in order to prevent attenuation of the sound at the frequency $f_0$, it is necessary to select the resistance value R of the resistor 50 and the capacitance C of the capacitor 49 those allowing the frequency $f_c$ to be sufficiently higher than the frequency $f_0$.

Figure 5A:
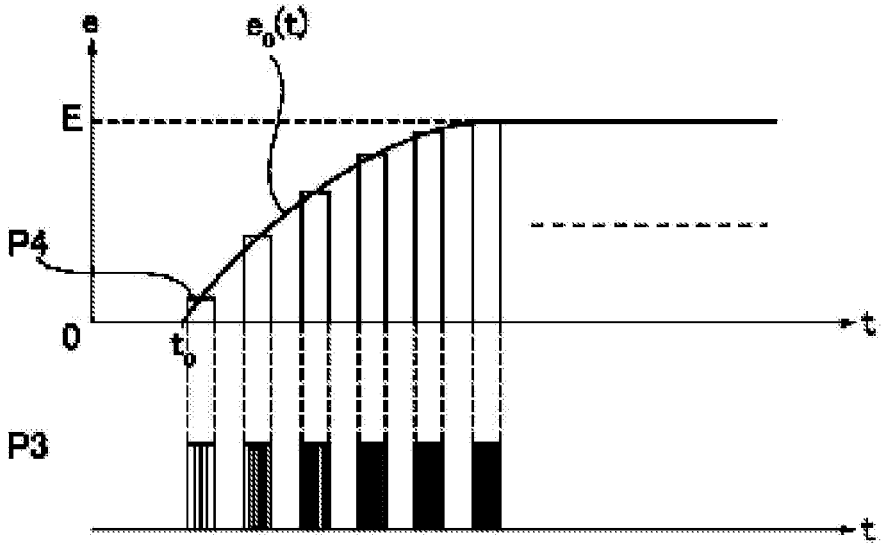
FIG. 5A illustrates a waveform of a voltage immediately after the input of the buzzer driving signal taken out from a waveform of a voltage output from the buzzer driving unit when a buzzer driving signal set to change the duty ratio according to time is input to the buzzer driving unit.

FIG. 5A is a diagram illustrating a waveform of a voltage e applied to the buzzer 60 when the buzzer driving signal P3 illustrated in FIG. 3E is input to the buzzer driving unit 40 in FIG. 1. Also, FIG. 5B is a diagram illustrating the waveform of the voltage e applied to the buzzer 60 when the buzzer driving signal P3 being input to the buzzer driving unit 40 is stopped.

Figure 5B:
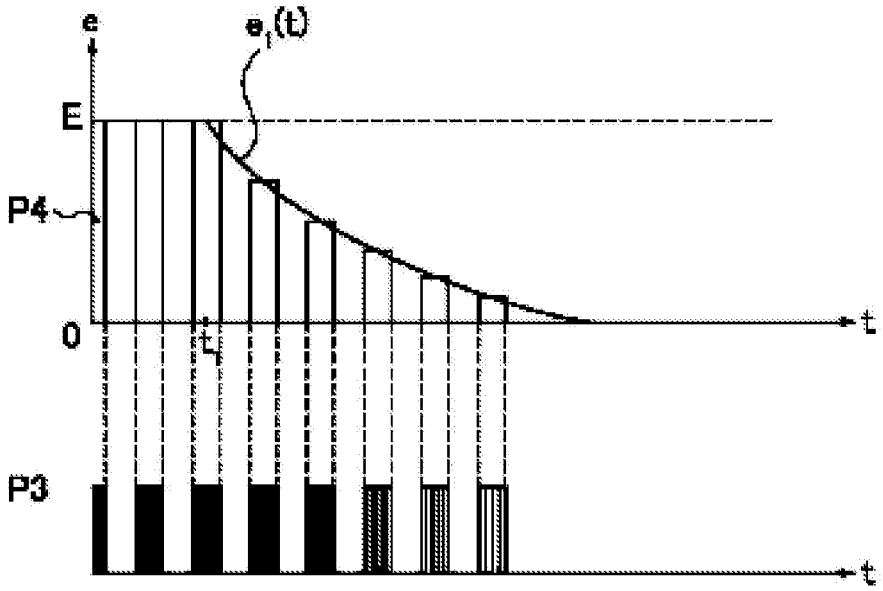
FIG. 5B illustrates a waveform of a voltage immediately after the end of the buzzer driving signal taken out from the waveform of the voltage output from the buzzer driving unit when the buzzer driving signal set to change the duty ratio according to time is input to the buzzer driving unit.

FIG. 5A and FIG. 5B respectively illustrate the voltage $e_0(t)$ appearing at the both ends of the capacitor 49 in FIG. 4.

As illustrated in FIG. 5A, when the duty ratio Di of the buzzer driving signal P3 is set to gradually increase as described above, immediately after the time t0 at which the buzzer driving signal P3 is input, the buzzer driving signal P3 with a small duty radio Di is input. Thereby, amplitude of the voltage e applied to the buzzer 60 becomes small. As the duty ratio Di gradually increases, the amplitude of the voltage e applied to the buzzer 60 also increases. When a predetermined time has elapsed, the duty ratio Di reaches a predetermined constant value, whereby the amplitude of the voltage e applied to the buzzer 60 becomes constant.

As illustrated in FIG. 5B, further, when the duty ratio Di of the buzzer driving signal P3 is set to gradually decrease as described above, immediately before time t1 at which the input of the buzzer driving signal P3 stops, a waveform having the duty ratio Di at a constant large value is input, whereby the amplitude of the voltage e applied to the buzzer 60 becomes constant. After the stop of the input of the buzzer driving signal P3 at the time t1, as the duty ratio Di gradually decreases, the amplitude of the voltage e applied to the buzzer 60 also decreases. When a predetermined time has elapsed, the duty ratio reaches 0, whereby the amplitude of the voltage e applied to the buzzer 60 also becomes 0.

By appropriately setting the duty ratio Di of the buzzer driving signal P3, the amplitude of the voltage e applied to the buzzer 60 may be set so as to change according to time in a manner similar to the voltage $e_0(t)$ that appears at the both ends of the capacitor 49 as described above.

That is, when Di, g, and h represent the duty ratio in one segment Ri of the buzzer drive signal P3, gain of the switching element of the buzzer driving unit 40, and a pulse voltage of the buzzer driving signal P3, respectively, setting the duty ratio Di of the segment Ri according to Equation 4 allows creation of a state equivalent to a state in which the audio frequency pulse signal P1 is input, in a pseudo manner, via a low-pass filter having the cut-off frequency fc constituted by using the CR filter.

$$Di=(E/gh)*\{1-\exp(-2\pi f_c t)\} \quad \text{(Equation 4)}$$

(Effect of Embodiment)

Figure 6A:
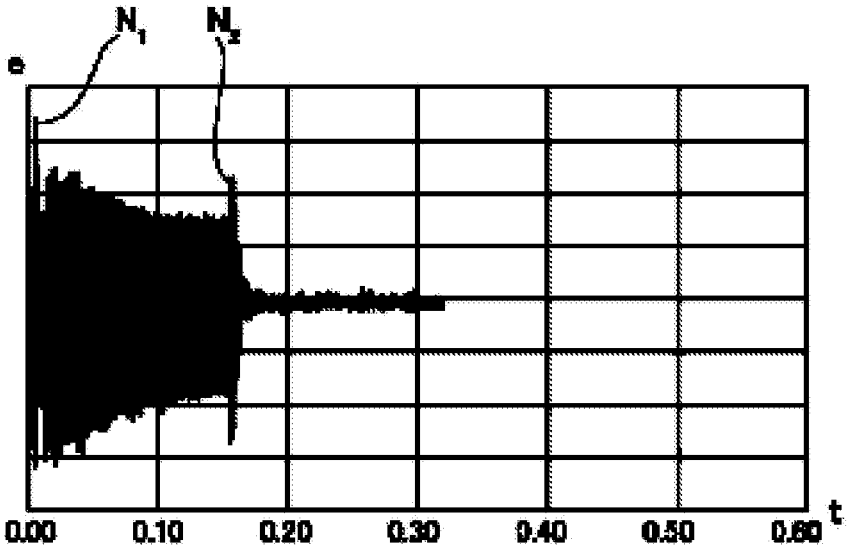
FIG. 6A is a diagram illustrating the waveform of the voltage when, by using a conventional method, the buzzer is made to sound by a buzzer driving circuit having no low-pass filter.

Next, an effect of the present embodiment will be described with reference to FIGS. 6. FIG. 6A illustrates a waveform of the amplitude of the voltage e applied to the buzzer 60 when the audio frequency pulse signal P1 having the duty ratio at a constant value is input to the buzzer driving unit 40 so as to sound the buzzer 60, without using the low-pass filter.

Figure 6B:
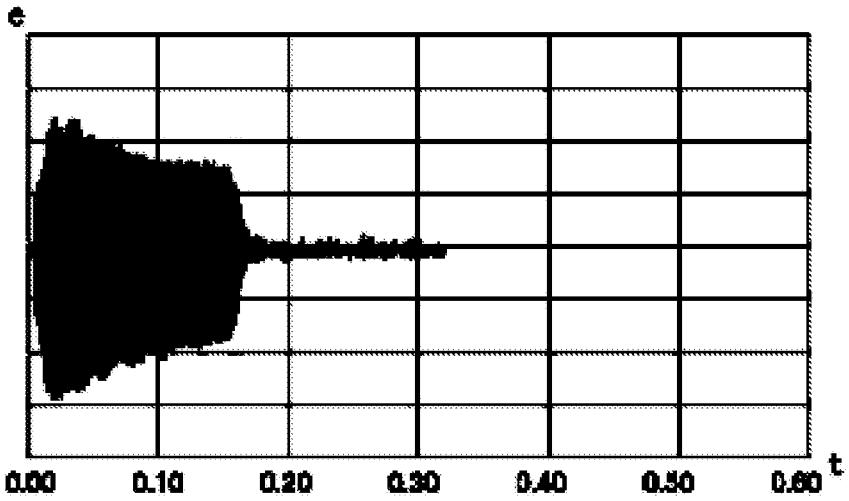
FIG. 6B is a diagram illustrating the waveform of the voltage when, by using the buzzer driving signal set to change the duty ratio according to time, the buzzer is made to sound by the buzzer driving circuit having no low-pass filter.

Also, FIG. 6B illustrates a waveform of the amplitude of the voltage e applied to the buzzer 60 when the buzzer driving signal P3 having a predetermined duty ratio Di set by the first duty ratio setting unit 30 is input to the buzzer driving unit 40 so as to sound the buzzer 60, without using the low-pass filter.

As can be seen in FIG. 6A, a spike-like noise N1 is generated at the start of the application of the voltage e to the buzzer 60 and, further, a spike-like noise N2 is generated at the end of the application of the voltage e to the buzzer 60. When the noise N1 or the noise N2 is applied to the buzzer 60, an instantaneous abnormal noise is generated from the buzzer 60.

As can be seen in FIG. 6B, on the other hand, a rising voltage in a first portion of the amplitude of the voltage e applied to the buzzer 60 and a falling voltage in a last portion of the amplitude of the voltage e gradually change, reproducing a waveform output when a rectangular wave is passed through the CR filter. Therefore, the buzzer 60 may sound without noise contaminated by the noises N1 and N2 generated in FIG. 6A.

(Operation of First Embodiment)

Figure 7:
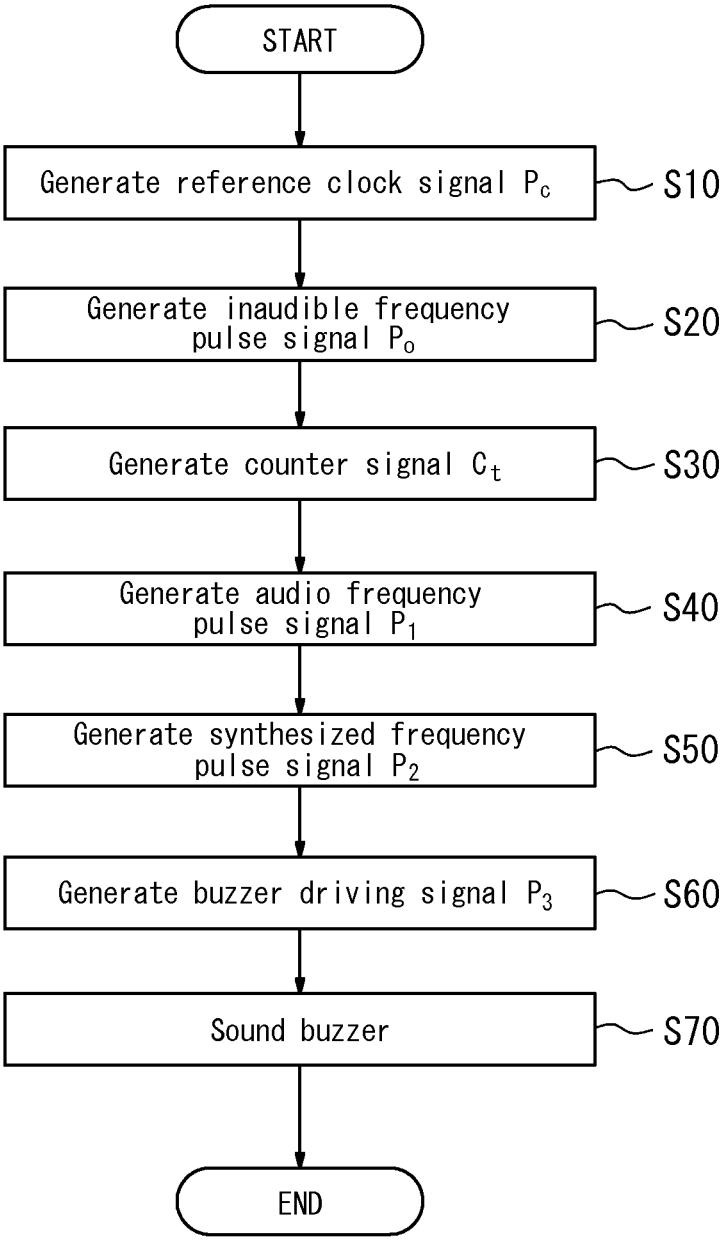
FIG. 7 is a flowchart illustrating procedure of the first embodiment.

Next, a procedure to sound the buzzer 60 according to the first embodiment will be described with reference to a flowchart in FIG. 7.

(Step S10) The clock signal generation unit 10 generates the reference clock signal Pc.

(Step S20) The inaudible frequency signal generation unit 22 divides the reference clock signal Pc and thus generates the inaudible frequency pulse signal P0 having the predetermined inaudible frequency.

(Step S30) The pulse counter 24 counts the number of inaudible frequency pulse signals P0 and thus generates the counter signal Ct.

(Step S40) The audio frequency signal generation unit 26 generates the audio frequency pulse signal P1 based on the inaudible frequency pulse signal P0 and the counter signal Ct.

(Step S50) The signal synthesizing unit 28 operates the logical product of the inaudible frequency pulse signal P0 and the audio frequency pulse signal P1 and thus generates the synthesized frequency pulse signal P2.

(Step S60) The first duty ratio setting unit 30 changes the duty ratio of the inaudible frequency pulse signal P0 in the synthesized frequency pulse signal P2 to the predetermined duty ratio Di over the first predetermined period of the synthesized frequency pulse signal P2. Also, the second duty ratio setting unit 32 changes the duty ratio of the signal having the duty ratio set by the first duty ratio setting unit 30 to the predetermined duty ratio Di over the last predetermined period of the signal. Thereby, the buzzer driving signal P3 is generated.

(Step S70) The buzzer driving signal P3 is input to the buzzer driving unit 40, whereby the buzzer 60 sounds.

As described above, according to the buzzer output control device 100 of the first embodiment, the inaudible frequency signal generation unit 22 generates the inaudible frequency pulse signal P0 having the predetermined inaudible frequency, and the audio frequency signal generation unit 26 generates, from the inaudible frequency pulse signal P0, the audio frequency pulse signal P1 having the predetermined audio frequency lower than the inaudible frequency. Next, the signal synthesizing unit 28 synthesizes the inaudible frequency pulse signal P0 and the audio frequency pulse signal P1 and thus generates the synthesized frequency pulse signal P2 having the inaudible frequency pulse signal P0 in the ON time of the audio frequency pulse signal P 1. Then, the first duty ratio setting unit 30 sets the duty ratio Di of the inaudible frequency pulse signal P0 in the synthesized frequency pulse signal P2 to gradually increase over the first predetermined period of the synthesized frequency pulse signal P2, thereby generating the buzzer driving signal P3. Here, since the buzzer driving unit 40 makes the buzzer 60 sound with the pitch corresponding to the frequency of the buzzer driving signal P3 and the volume corresponding to the duty ratio Di of the buzzer driving signal P3, the peak value of the voltage e applied to the buzzer 60 gradually increases over time immediately after the application of the buzzer driving signal P3. Thereby, the occurrence of the inrush current may be prevented. Accordingly, without inserting the low-pass filter into the buzzer driving unit 40, the buzzer 60 may sound without noise contamination.

According to the buzzer output control device 100 of the first embodiment, also, the inaudible frequency signal generation unit 22 generates the inaudible frequency pulse signal P0 having the predetermined inaudible frequency, and the audio frequency signal generation unit 26 generates, from the inaudible frequency pulse signal P0, the audio frequency pulse signal P1 having the predetermined audio frequency lower than the inaudible frequency. Next, the signal synthesizing unit 28 synthesizes the inaudible frequency pulse signal P0 and the audio frequency pulse signal P1 and thus generates the synthesized frequency pulse signal P2 having the inaudible frequency pulse signal P0 in the ON time of the audio frequency pulse signal P1. Then, the first duty ratio setting unit 30 sets the duty ratio Di of the inaudible frequency pulse signal P0 in the synthesized frequency pulse signal P2 to gradually decrease over the last predetermined period of the synthesized frequency pulse signal P2, thereby generating the buzzer drive signal P3. Here, since the buzzer driving unit 40 makes the buzzer 60 sound with the pitch corresponding to the frequency of the buzzer driving signal P3 and the volume corresponding to the duty ratio Di of the buzzer driving signal P3, the peak value of the voltage e applied to the buzzer 60 gradually decreases over time immediately after the end of the buzzer driving signal P3. Thereby, the occurrence of the counter electromotive force may be prevented when the buzzer 60 serving as an inductive load is turned OFF. Accordingly, without inserting the low-pass filter into the buzzer driving unit 40, the buzzer 60 may sound without noise contamination.

According to the buzzer output control method using the buzzer output control device 100 of the first embodiment, the buzzer 60 sounds on the buzzer driving signal P3 that is set to gradually increase the duty ratio Di of the inaudible frequency pulse signal P0 in the synthesized frequency pulse signal P2 over the first predetermined period of the synthesized frequency pulse signal P2. Thereby, the occurrence of the inrush current may be prevented. Accordingly, without passing the buzzer driving signal P3 through the low-pass filter, the buzzer 60 may sound without noise contamination.

According to the buzzer output control method using the buzzer output control device 100 of the first embodiment, further, the buzzer 60 sounds on the buzzer driving signal P3 that is set to gradually reduce the duty ratio Di of the inaudible frequency pulse signal P0 in the synthesized frequency pulse signal P2 over the last predetermined period of the synthesized frequency pulse signal P2. Thereby, the occurrence of the counter electromotive force may be prevented when the buzzer 60 serving as the inductive load is turned OFF. Accordingly, without passing the buzzer driving signal P3 through the low-pass filter, the buzzer 60 may sound without noise contamination.

Note that, although in the present embodiment the duty ratio Di of the inaudible frequency pulse signal P0 in the synthesized frequency pulse signal P2 is set for each of the segments R1, R2, . . . , Ri, . . . , and R2, the duty ratio may be set at once in a time axis direction, and the buzzer deriving signal P3 may be generated by synthesizing the inaudible frequency pulse signal P0 having the duty ratio set in this manner and the audio frequency pulse signal P1. In this case, the first duty ratio setting unit 30 and the second duty ratio setting unit 32 do not need to be separately prepared as illustrated in FIG. 1; it may be configured to have one duty ratio setting unit provided between the inaudible frequency signal generation unit 22 and the signal synthesizing unit 28. That is, as long as a waveform the same as that of the buzzer driving signal P3 may be formed, the procedure of signal processing is not limited to that carried out with an internal structure of the buzzer driving signal generation unit 20 illustrated in FIG. 1.

Also, although the present embodiment uses an example in which the buzzer 60 sounds at the frequency of 2 kHz, a value of the cut-off frequency $f_c$ may be set by using the Equation 4 according to the frequency $f_0$ of the desired sound of the buzzer 60. Therefore, the number of pulses counted by the pulse counter 24 is changed according to the frequency $f_0$; the audio frequency signal generation unit 26 generates the audio frequency pulse signal P1 at the frequency of $f_0$; the signal synthesizing unit 28 synthesizes the inaudible frequency pulse signal $P_0$ and the audio frequency pulse signal P1 and thus generates the buzzer driving signal P3 with the duty ratio Di changed following a setting pattern thereof according to the cut-off frequency $f_c$ set according to the frequency $f_0$; and the buzzer 60 sounds on the buzzer driving signal P3 thus generated. Thereby, the buzzer 60 may sound at the desired frequency $f_0$ without noise contamination.

According to the buzzer output control method as described above, further, the duty ratio Di of the buzzer driving signal P3 is set by the first duty ratio setting unit 30 and/or the second duty ratio setting unit 32, in such a manner that the waveform of the voltage e that is generated when the buzzer driving signal P3 having the duty ratio Di set in the above manner is input to the buzzer driving unit 40 forms the same waveform as that of the voltage generated when the audio frequency pulse signal P1 is passed through the low-pass filter. Therefore, the same effect as the low-pass filter inserted into the buzzer driving unit 40 may be obtained. Accordingly, without inserting the low-pass filter into the buzzer driving unit 40, the buzzer 60 may sound without noise contamination.

Although the embodiment has been described in detail with reference to the accompanying drawings, the embodiment is used by way of example only. Accordingly, the present invention is not limited to the above embodiment, and design changes within the scope of the present invention are also included in the present invention, as a matter of course.

REFERENCE SIGNS LIST

10 clock signal generation unit
20 buzzer driving signal generation unit
22 inaudible frequency signal generation unit
24 pulse counter
26 audio frequency signal generation unit
28 signal synthesizing unit
30 first duty ratio setting unit
32 second duty ratio setting unit
40 buzzer driving unit
60 buzzer
100 buzzer output control device

The invention claimed is:

1. A buzzer output control apparatus comprising:

a buzzer for outputting a sound having a pitch corresponding to a frequency of a buzzer driving signal being input and volume corresponding to a duty ratio of the buzzer driving signal;

an inaudible frequency signal generation unit for generating an inaudible frequency pulse signal having a predetermined inaudible frequency;

an audio frequency signal generation unit for generating an audio frequency pulse signal having a predetermined audio frequency lower than the inaudible frequency;

a signal synthesizing unit for synthesizing the inaudible frequency pulse signal and the audio frequency pulse signal and thus generating a synthesized frequency pulse signal having the inaudible frequency pulse signal in an ON time of the audio frequency pulse signal;

a first duty ratio setting unit for generating a buzzer driving signal set to gradually increase a duty ratio of the inaudible frequency pulse signal in the synthesized frequency pulse signal over a first predetermined period of the synthesized frequency pulse signal; and a buzzer driving unit for sounding the buzzer on the buzzer driving signal.

2. A buzzer output control apparatus comprising:

a buzzer for outputting a sound having a pitch corresponding to a frequency of a buzzer driving signal being input and volume corresponding to a duty ratio of the buzzer driving signal;

an inaudible frequency signal generation unit for generating an inaudible frequency pulse signal having a predetermined inaudible frequency;

an audio frequency signal generation unit for generating an audio frequency pulse signal having a predetermined audio frequency lower than the inaudible frequency;

a signal synthesizing unit for synthesizing the inaudible frequency pulse signal and the audio frequency pulse signal and thus generating a synthesized frequency pulse signal having the inaudible frequency pulse signal in an ON time of the audio frequency pulse signal;

a second duty ratio setting unit for generating a buzzer driving signal set to gradually reduce a duty ratio of the inaudible frequency pulse signal in the synthesized frequency pulse signal over a last predetermined period of the synthesized frequency pulse signal; and a buzzer driving unit for sounding the buzzer on the buzzer driving signal.

3. A buzzer output control method comprising:

generating an inaudible frequency pulse signal having a predetermined inaudible frequency;

generating an audio frequency pulse signal having a predetermined audio frequency lower than the inaudible frequency;

generating a synthesized frequency pulse signal by incorporating the inaudible frequency pulse signal in an ON time of the audio frequency pulse signal;

generating a buzzer driving signal set to gradually increase a duty ratio of the inaudible frequency pulse signal in the synthesized audio frequency pulse signal over a first predetermined period of the synthesized frequency pulse signal; and on the buzzer driving signal, sounding the buzzer with a pitch corresponding to the frequency of the buzzer driving signal and volume corresponding to the duty ratio of the buzzer driving signal.

4. A buzzer output control method comprising:

generating an inaudible frequency pulse signal having a predetermined inaudible frequency;

generating an audio frequency pulse signal having a predetermined audio frequency lower than the inaudible frequency;

generating a synthesized frequency pulse signal by incorporating the inaudible frequency pulse signal in an ON time of the audio frequency pulse signal;

generating a buzzer driving signal set to gradually reduce a duty ratio of the inaudible frequency pulse signal in the synthesized audio frequency pulse signal over a last predetermined period of the synthesized frequency pulse signal; and on the buzzer driving signal, sounding the buzzer with a pitch corresponding to the frequency of the buzzer driving signal and volume corresponding to the duty ratio of the buzzer driving signal.

* * * * *